US008207899B2

(12) United States Patent
Ishimiya

(10) Patent No.: US 8,207,899 B2
(45) **Date of Patent: *Jun. 26, 2012**

(54) FOLDED DIPOLE ANTENNA DEVICE AND MOBILE RADIO TERMINAL

(75) Inventor: Katsunori Ishimiya, Tokyo (JP)

(73) Assignee: Sony Mobile Communications Japan, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/585,270

(22) Filed: Sep. 10, 2009

(65) Prior Publication Data

US 2010/0066628 A1 Mar. 18, 2010

Related U.S. Application Data

(63) Continuation of application No. 11/588,289, filed on Oct. 27, 2006, now Pat. No. 7,605,764.

(30) Foreign Application Priority Data

Nov. 18, 2005 (JP) ..... 2005-333783

(51) Int. Cl.
*H01Q 1/24* (2006.01)
*H01Q 9/26* (2006.01)

(52) U.S. Cl. ..... 343/702; 343/803

(58) Field of Classification Search ..... 343/702, 343/741, 803, 804, 846
See application file for complete search history.

(56) References Cited

U.S. PATENT DOCUMENTS

| | | | | |
|---|---|---|---|---|
| 4,516,127 | A | 5/1985 | Siwiak | |
| 4,955,084 | A | 9/1990 | Umetsu et al. | |
| 5,030,963 | A | 7/1991 | Tadama | |
| 5,365,246 | A | 11/1994 | Rasinger et al. | |
| 6,853,341 | B1 | 2/2005 | Hellgren et al. | |
| 7,136,022 | B2 | 11/2006 | Sato et al. | |
| 7,307,591 | B2 * | 12/2007 | Zheng | 343/702 |
| 7,358,906 | B2 * | 4/2008 | Sato et al. | 343/702 |
| 7,605,764 | B2 * | 10/2009 | Ishimiya | 343/702 |

FOREIGN PATENT DOCUMENTS

| | | |
|---|---|---|
| EP | 1 416 585 | 5/2004 |
| EP | 1 555 715 | 7/2005 |
| JP | 2002-043826 | 2/2002 |
| JP | 2004-023797 | 1/2004 |
| JP | 2004-228917 | 8/2004 |
| JP | 2004-228918 | 8/2004 |
| WO | WO-01/26182 | 4/2001 |
| WO | WO-2006/109184 | 10/2006 |

OTHER PUBLICATIONS

EPO Search Report Dated Mar. 7, 2007, 6 pages.

* cited by examiner

*Primary Examiner* — Michael C Wimer
(74) *Attorney, Agent, or Firm* — Rader Fishman & Grauer, PLLC

(57) ABSTRACT

Disclosed is a folded dipole antenna device which is of an unbalanced feed type and includes an antenna element of approximately plate-like loop structure, connected to an antenna feed point and an antenna ground provided on a base plate. In the folded dipole antenna device, the antenna element of loop structure includes a pair of first element sections which extend approximately parallel to the base plate, a second element section formed by merging element sections that are folded back from both ends of the first element sections and extend approximately parallel to the first element sections, and a third element section which extends from a folded top part of the second element section toward the first element sections and an end part thereof is close to the first element sections.

9 Claims, 11 Drawing Sheets

FIG. 2A
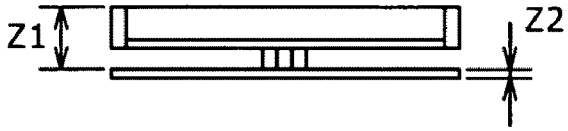
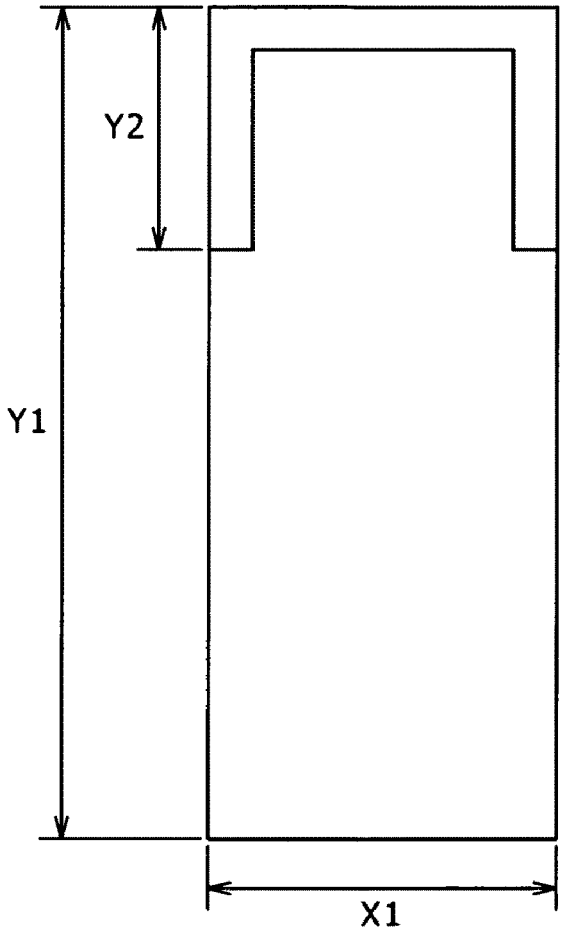
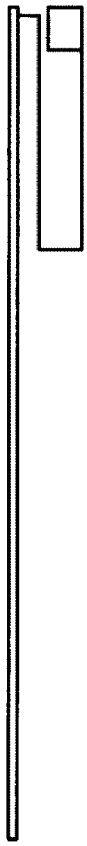
FIG. 2B FIG. 2C

1800MHz

FOLDED DIPOLE ANTENNA DEVICE AND MOBILE RADIO TERMINAL

CROSS REFERENCES TO RELATED APPLICATIONS

This is a Continuation Application of U.S. patent application Ser. No. 11/588,289, filed Oct. 27, 2006, which claims priority from Japanese Patent Application JP 2005-333783 filed in the Japanese Patent Office on Nov. 18, 2005, the entire contents of which are incorporated herein by reference.

BACKGROUND OF THE INVENTION

1. Field of the Invention

The present invention relates to a folded dipole antenna incorporated in a mobile radio terminal, such as a cellular phone, and a mobile radio terminal therewith.

2. Description of the Related Art

Heretofore, folded dipole antennas have supported only a single band (approximately 2 GHz), and there have been limitations in size and shape at the time of incorporation into a cellular phone.

On the other hand, Patent document 1 discloses a single piece, twin folded dipole antenna supporting a plurality of frequency bands.

Further, Patent documents 2 and 3 disclose a folded dipole antenna incorporated in a mobile terminal and capable of impedance matching over a wide bandwidth without loading a complicated passive element or using an expensive matching device.

Patent document 4 discloses a small-sized wide-band antenna device which does not suffer a large fall in gain even when used in proximity to a human body.

[Patent document 1] Japanese Patent Application Laid-Open No. 2004-23797

[Patent document 2] Japanese Patent Application Laid-Open No. 2004-228917

[Patent document 3] Japanese Patent Application Laid-Open No. 2004-228918

[Patent document 4] Japanese Patent Application Laid-Open No. 2002-43826

SUMMARY OF THE INVENTION

With the development and proliferation of mobile radio terminals in recent years, studies have been made of even more multiple bands with one internal antenna device, for the sake of further convenience. The antenna device described in Patent document 1 extends in the form of a V with respect to a ground plane, and this shape is not suitable as an antenna incorporated in a mobile terminal. Although Patent documents 2 and 3 disclose an antenna incorporated in a mobile terminal and capable of impedance matching over a wide bandwidth, there is yet room for improvement in even more multiple bands. Patent document 4 refers to three resonance characteristics; however, this is carried out by using a passive element.

The present invention has been made in view of the foregoing and provides a folded dipole antenna device as an even more wide-band antenna device incorporated in a mobile radio terminal without using a passive element and a mobile radio terminal therewith.

A folded dipole antenna device according to an embodiment of the invention is of an unbalanced feed type, and it includes an antenna element of approximately plate-like loop structure, connected to an antenna feed point and an antenna ground provided on a base plate. In the folded dipole antenna device, the antenna element of loop structure includes a pair of first element sections which extend approximately parallel to the base plate, a second element section formed by merging element sections that are folded back from both ends of the first element sections and extend approximately parallel to the first element sections, and a third element section which extends from a folded top part of the second element section toward the first element sections and an end part thereof is close to the first element sections.

With the folded dipole antenna structure of the first element sections and the second element section, a first and a second resonance points can be obtained at a frequency whose half wavelength ($\lambda/2$) corresponds to the antenna element length including the first element sections and the second element section and at a frequency whose wavelength ($\lambda$) corresponds to the antenna element length. Further, with the addition of the third element section, a third resonance point can be obtained at a frequency whose three-quarters wavelength ($\frac{3}{4}\lambda$) corresponds to the antenna element length. Thereby, it is possible to achieve an extremely wide-band antenna device. Further, the folded antenna element structure can shrink the size of an internal antenna.

According to another embodiment of the invention, there is provided a mobile radio terminal incorporating the folded dipole antenna device.

A specific structure and further operational advantages of the invention will be described in the following embodiment.

The embodiments of the present invention make it possible to provide an even more wide-band antenna device capable of being incorporated in a mobile radio terminal by devising the antenna element structure without adding a passive element, thereby enabling more multiple bands than ever before.

BRIEF DESCRIPTION OF THE DRAWINGS

Embodiments of the present invention will be described in detail based on the following figures, wherein:

FIGS. 2A, 2B, 2C are a front view, a plan view, and a left side view of the antenna device shown in FIGS. 1A and 1B, respectively.

DESCRIPTION OF THE PREFERRED EMBODIMENTS

Hereinafter, a preferred embodiment of the present invention will be described in detail with reference to the accompanying drawings.

Figure 1A:
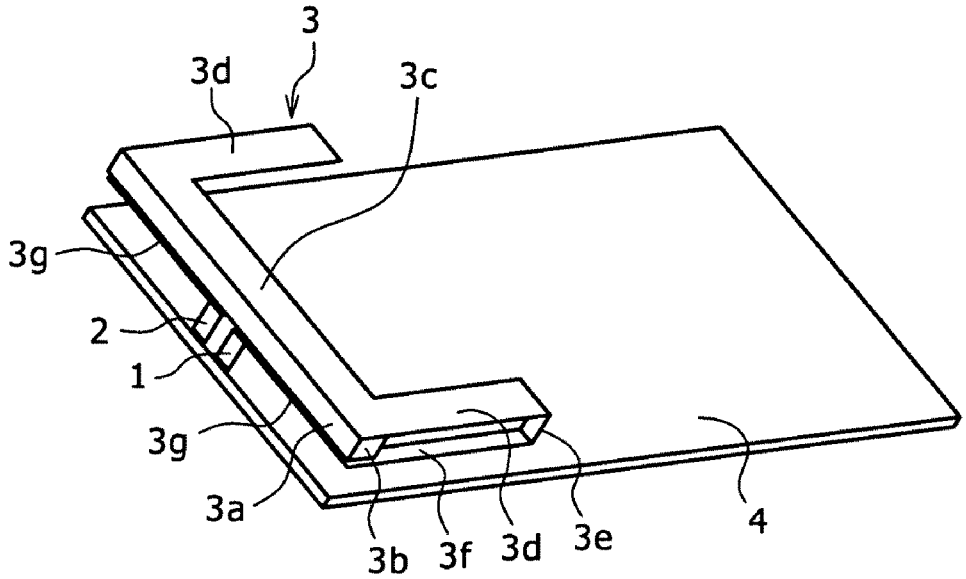
FIGS. 1A and 1B are perspective views showing the principal part of a folded dipole antenna device according to an embodiment of the present invention, taken from different viewpoints.
Figure 1B:
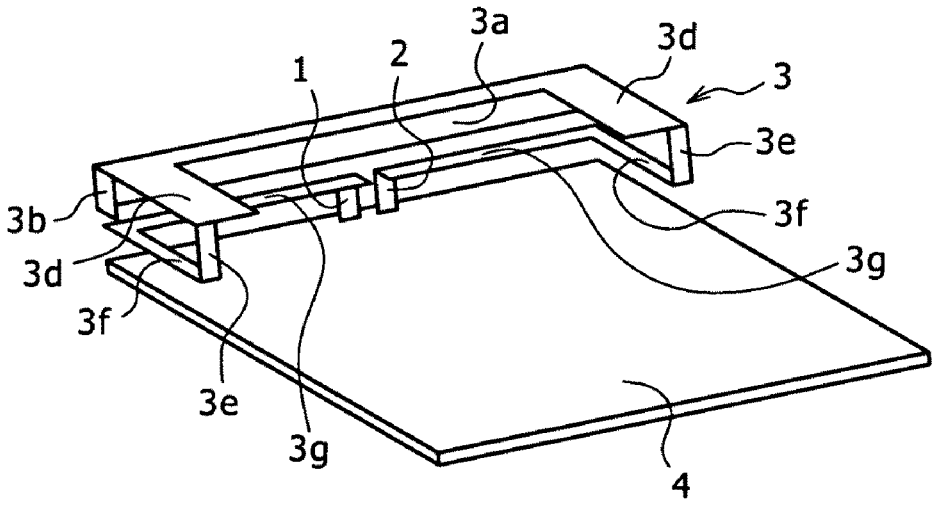

FIGS. 1A and 1B are perspective views showing the principal part of a folded dipole antenna device according to this embodiment, taken from different viewpoints.

In this embodiment, the procedure of designing the antenna device is as follows. First, in order to produce resonance in GSM (Global System for Mobile Communications) 850/900, the antenna element length is set to approximately λ/2 relative to this frequency band. Further, the antenna element is folded in two along the shape of a base (which corresponds to a base plate 4) so as to be compactly accommodated within the enclosure of a mobile radio terminal. The element length is λ in the 2 GHz band (PCS (Personal Communication System) and UMTS (Universal Mobile Telecommunications System) band). Accordingly, by the self-balancing action of the antenna, the antenna itself becomes a balanced antenna even under unbalanced feeding. Further, an additional extension section is provided at the top part of the folded element, thereby making it possible to produce resonance in the 1.8 GHz band as well. Consequently, it is possible to support multibands (five bands).

As shown in FIGS. 1A and 1B, in this embodiment, an antenna feed point 1 and an antenna ground 2 are disposed relatively close to each other approximately in the center part of one end of a base plate (ground) 4. The antenna feed point 1 and the antenna ground 2 are connected to an antenna radiation plate 3. The antenna device to which the invention is applied is of an unbalanced feed type. The antenna radiation plate 3 is constructed symmetrically with respect to the antenna feed point 1 and the antenna ground 2.

More specifically, the antenna feed point 1 and the antenna ground 2 each have a section standing upright on the base plate 4. The upright section is connected at the end to an element section 3*g* which extends outwardly therefrom, parallel to the base plate 4. The element section 3*g* is connected at the end to an element section 3*f* which is bent at an approximately right angle along a side edge of the base plate 4. The element section 3*f* extends a predetermined length and is connected at the end to an element section 3*e* (a turn-up section), which extends upwardly, perpendicular to the base plate 4. Further, the element section 3*e* is connected to an element section 3*d* which returns to the end part of the base plate 4, approximately parallel to the element section 3*f*. The width of the element section 3*d* is set so as to be larger than that of the element section 3*f*, thereby facilitating the element section 3*d* to radiate radio waves. Both element sections 3*d* are connected to an element section 3*c* which exists therebetween. The element section 3*c* is connected at the outer edge to an element section 3*a* which is bent toward the element section 3*g*. Further, the element section 3*a* is connected at both sides to element sections 3*b* which project therefrom. Both the element sections 3*b* are bent toward the respective element sections 3*e*.

The element sections 3*g* and 3*f* constitute a pair of first element sections, which extend approximately parallel to the base plate 4. The element sections 3*e*, 3*d*, and 3*c* constitute a second element section formed by merging element sections that are folded back and extend approximately parallel to the first element sections. Further, the element section 3*a* constitutes a third element section which extends from the folded top part of the second element section toward the first element sections and an end part thereof is close to the first element sections. The element sections 3*b* constitute fourth element sections, which extend between the first element sections and the second element section.

FIGS. 2A, 2B, 2C show a front view, a plan view, and a left side view of the antenna device shown in FIGS. 1A and 1B, respectively.

Figure 3:
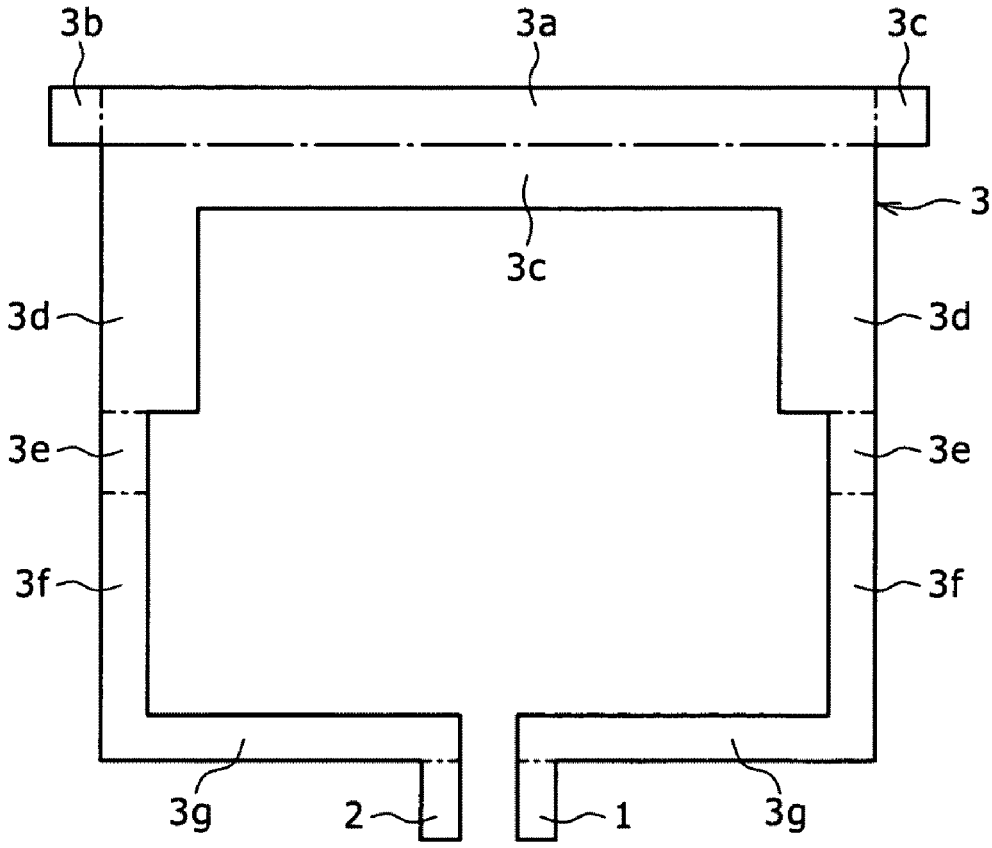
FIG. 3 is a development view showing the structure of an antenna element of the antenna device shown in FIGS. 1A and 1B.

The entire antenna element can be constructed of a conductive member shaped like a one-piece metal plate. FIG. 3 is a development view thereof. In FIG. 3, broken lines indicate mountain-fold portions, and alternate long and short dashed lines indicate valley-fold portions. However, the antenna element according to the invention is not necessarily required to be formed with such a one-piece plate, and it may be constructed by electrically joining separated components. However, the one-piece plate structure eliminates the need for joining work.

Figure 4:
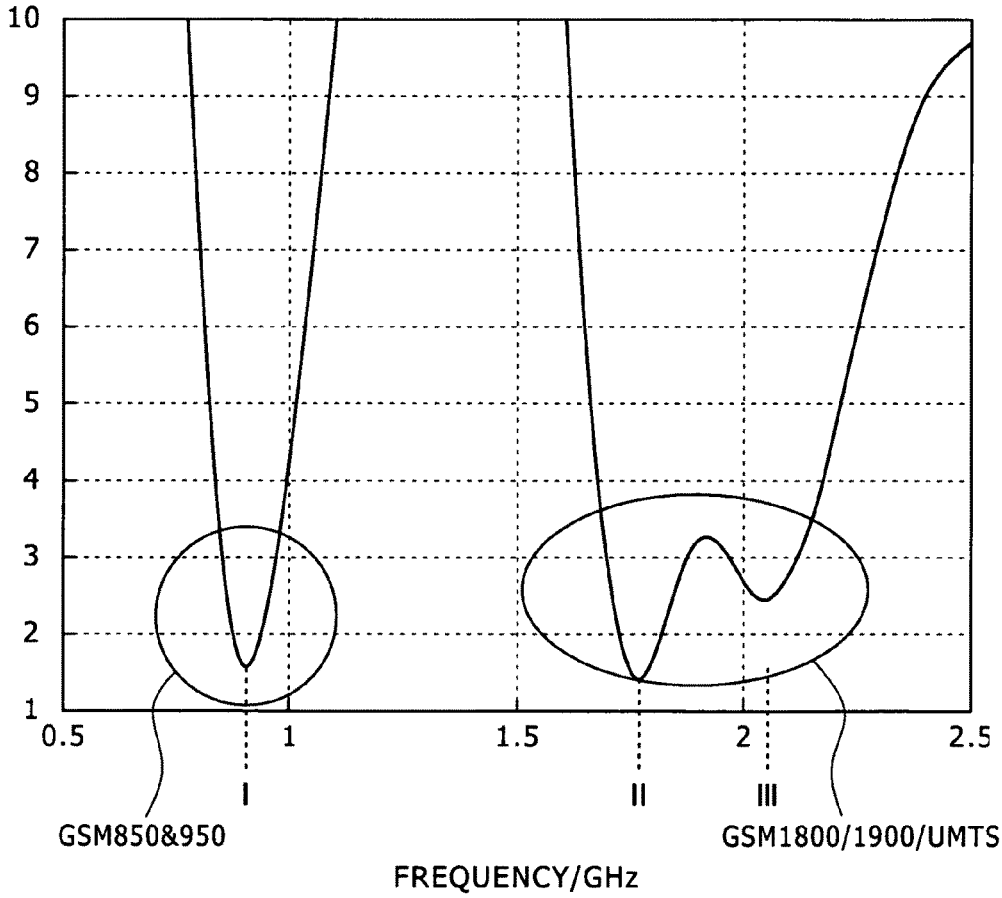
FIG. 4 is a graph showing a characteristic measurement result of the antenna device of the embodiment shown in FIGS. 1A and 1B.

FIG. 4 is a graph showing a characteristic measurement result of the antenna device of this embodiment shown in FIGS. 1A and 1B. In FIG. 4, the vertical axis represents the voltage standing wave ratio (VSWR), and the horizontal axis represents the frequency. The part sizes of the antenna device used for the measurement are as follows.

All dimensions in are mm.

The size of the base plate 4 (Y1×X1×Z2): 99×39×1

The height from the base plate 4 to the antenna element 3*c* (Z1): 7

The length of the antenna element 3*d* (Y2): 28

The width of the antenna element 3*d* (X2): 5

As can be seen from this graph, three resonance points I, II, and III are obtained by the antenna device shown in FIGS. 1A and 1B, thereby providing the antenna characteristic of a frequency band extremely wider than before. This bandwidth can cover, for example, five bands of GSM 850/900/1800/1900/UMTS as existing radio communication bands.

According to the consideration of the present inventor, the addition of the element section 3*a* (and the element sections 3*b*) has added a new resonance point II. The condition of the element section 3*a* is to extend from one edge of the element section 3*c* to the vicinity of the element sections 3*g*. The element sections 3*b* extend from the sides of the element section 3*a*. The length of the element section 3*a* and the length of the element sections 3*b* can fine-tune the frequency at the resonance point II.

Figure 5:
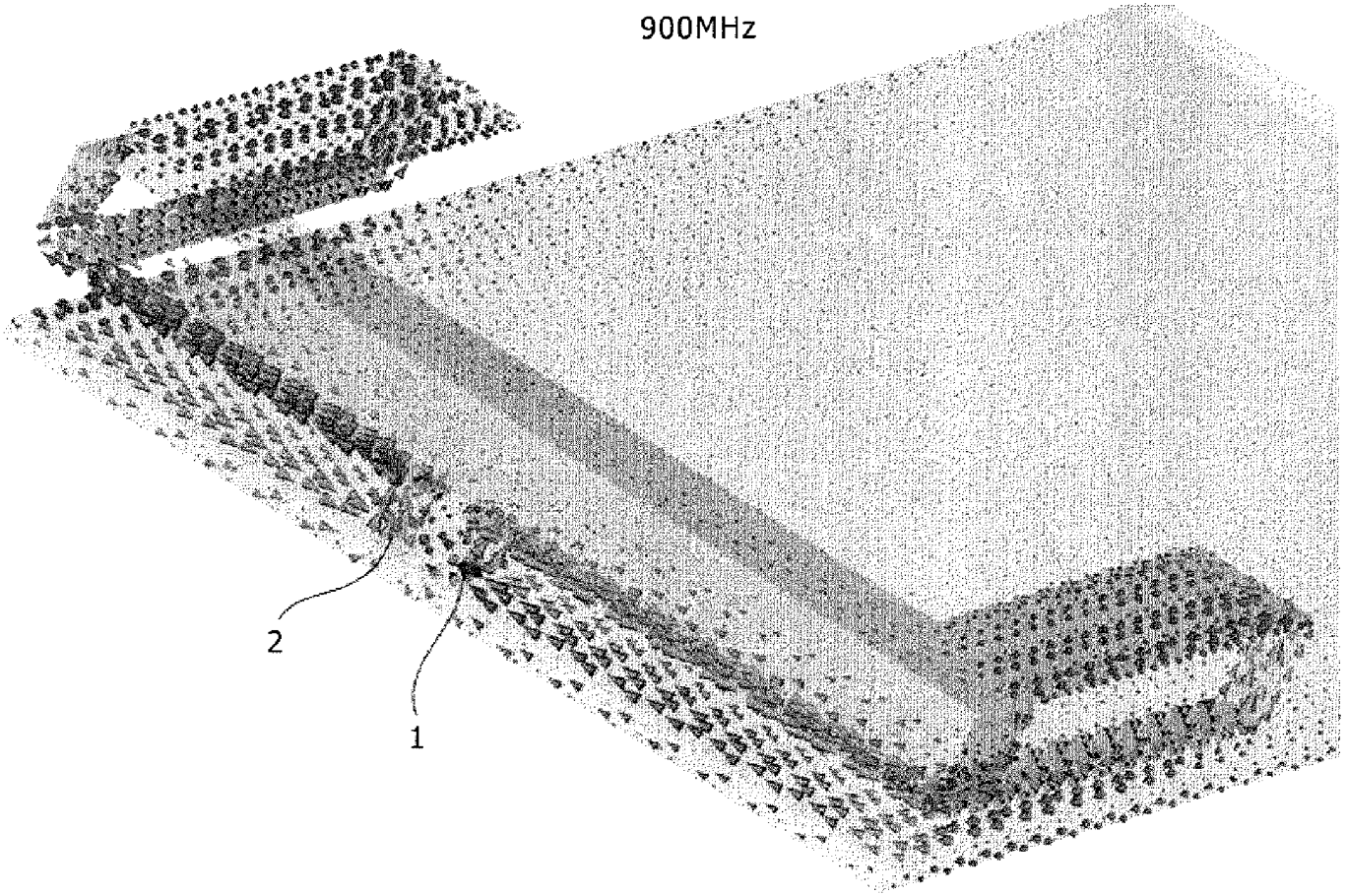
FIG. 5 is a diagram showing current vectors indicative of the states of electric currents flowing through each part of the antenna device in a 900 MHz band.
Figure 6A:
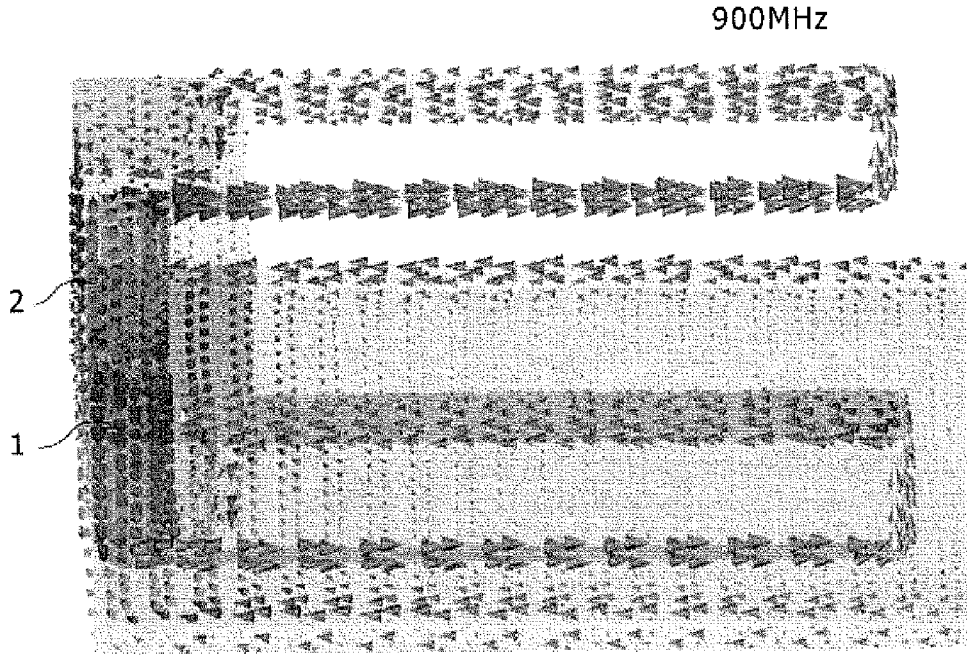
FIGS. 6A and 6B are diagrams showing current vectors indicative of the states of electric currents flowing through each part of the antenna device in the 900 MHz band, taken from two viewpoints different from FIG. 5.
Figure 6B:
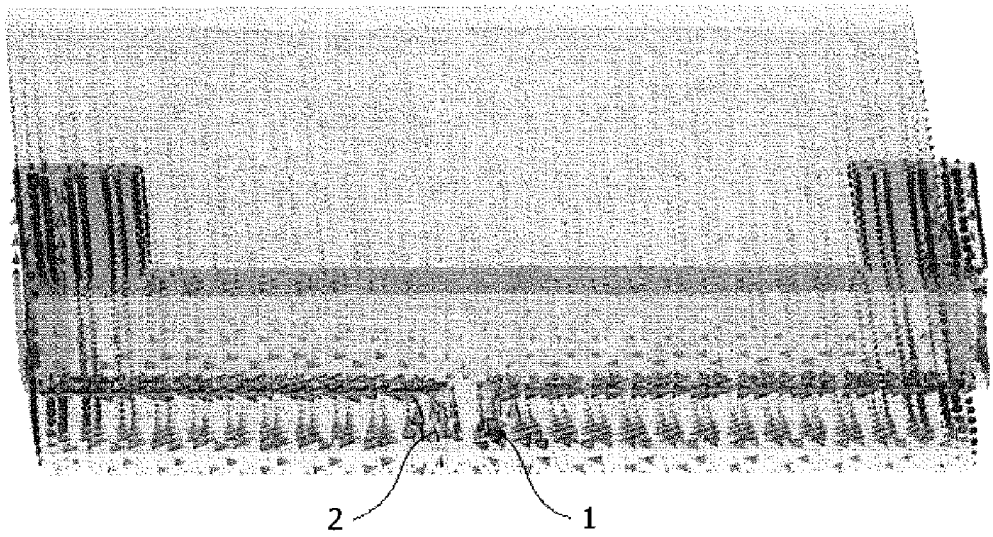

FIGS. 5, 6A, and 6B show current vectors indicative of the states of electric currents flowing through each part of the antenna device in the 900 MHz band, viewed from three viewpoints. In the figures, the direction of triangle marks indicates the direction of electric currents, and the size of triangle marks indicates the size of electric currents. As can be seen from the figures, electric currents flow approximately symmetrically with respect to the antenna feed point 1 and the antenna ground 2. That is, the flows of currents are in opposite phase. The element length of the antenna device corresponds to λ/2 relative to this frequency band.

Figure 7:
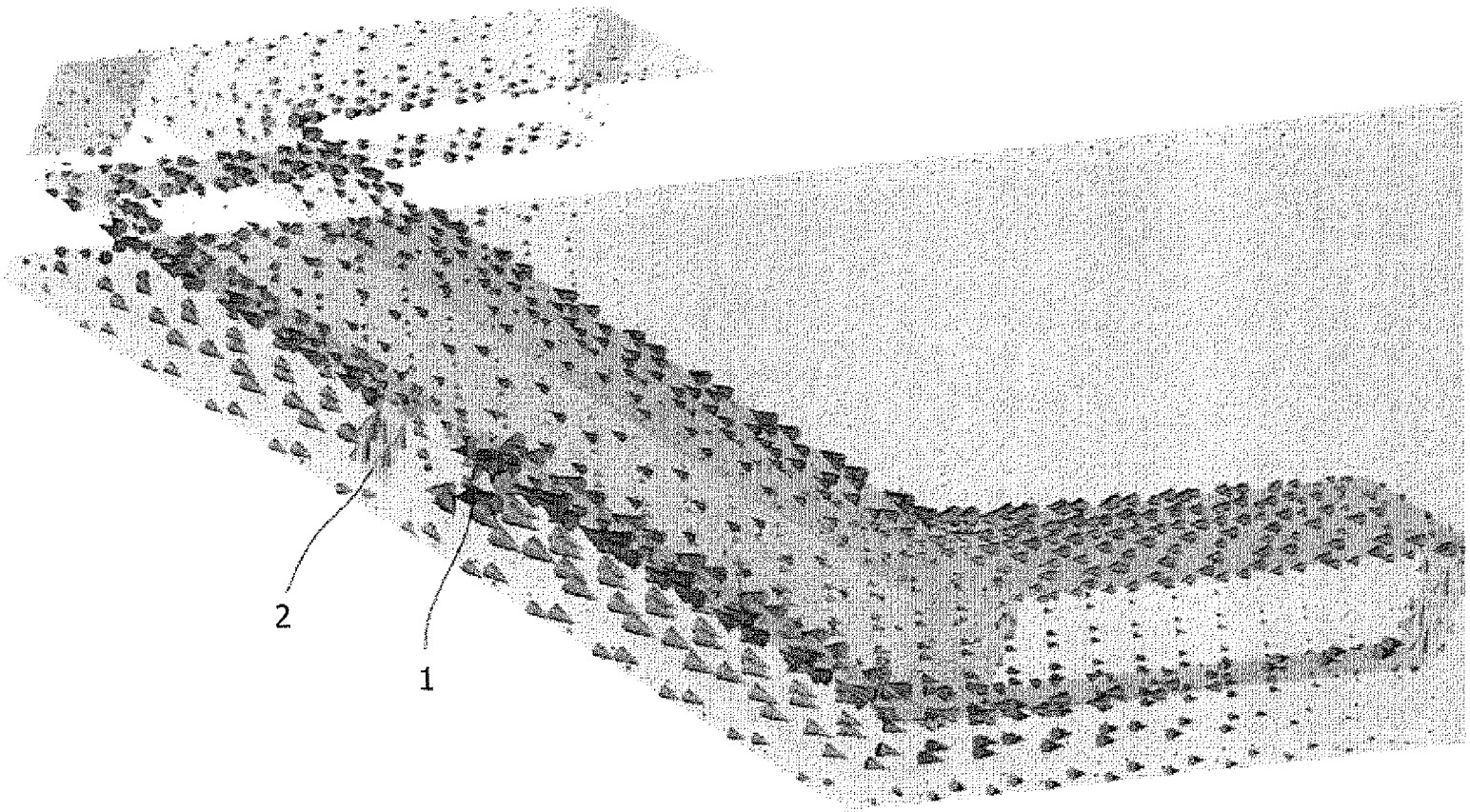
FIG. 7 is a diagram showing current vectors indicative of the states of electric currents flowing through each part of the antenna device in a 1800 MHz band.
Figure 8A:
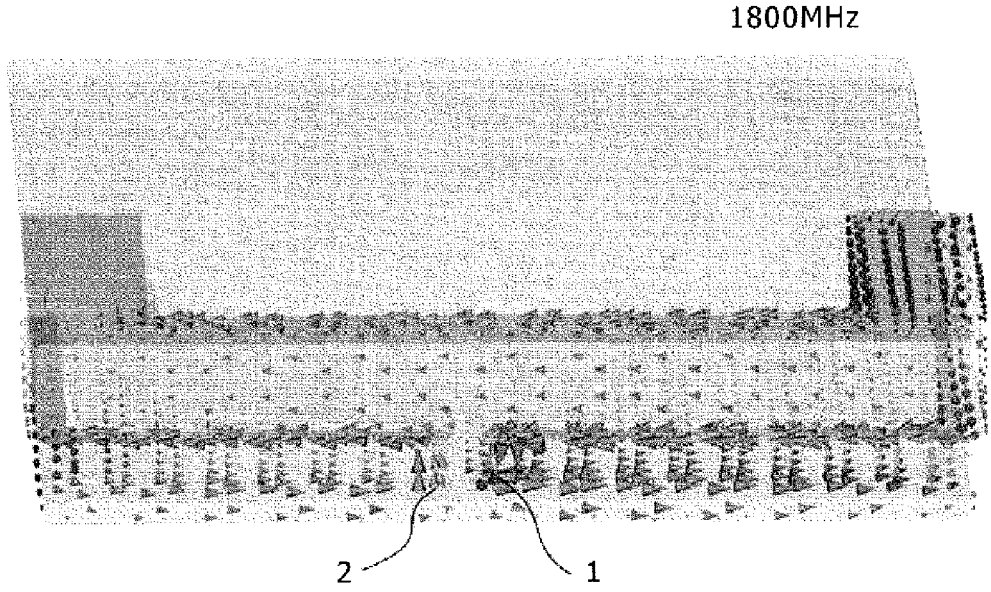
FIGS. 8A and 8B are diagrams showing current vectors indicative of the states of electric currents flowing through each part of the antenna device in the 1800 MHz band, taken from two viewpoints different from FIG. 7.
Figure 8B:
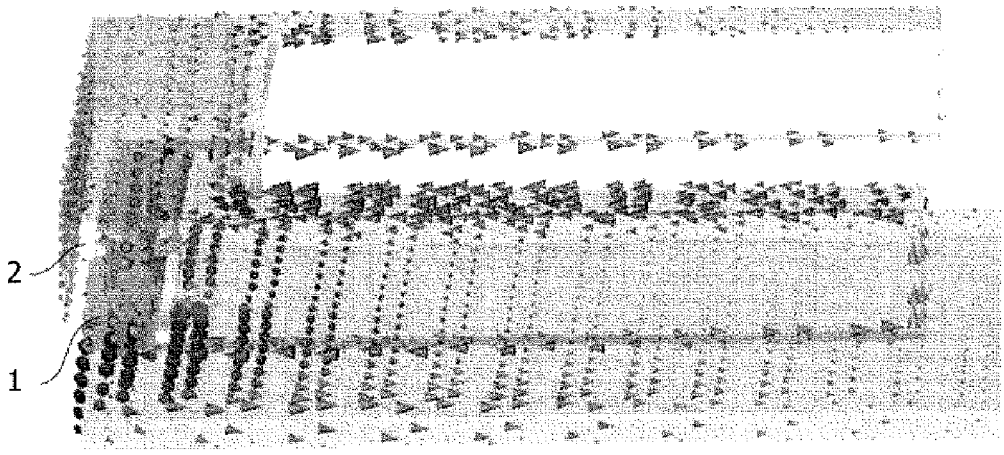

FIGS. 7, 8A, and 8B show current vectors indicative of the states of electric currents flowing through each part of the antenna device in the 1800 MHz band, viewed from three viewpoints. In this case, the flows of currents are in phase. The element length of the antenna device corresponds to ¾λ relative to this frequency band.

Figure 9:
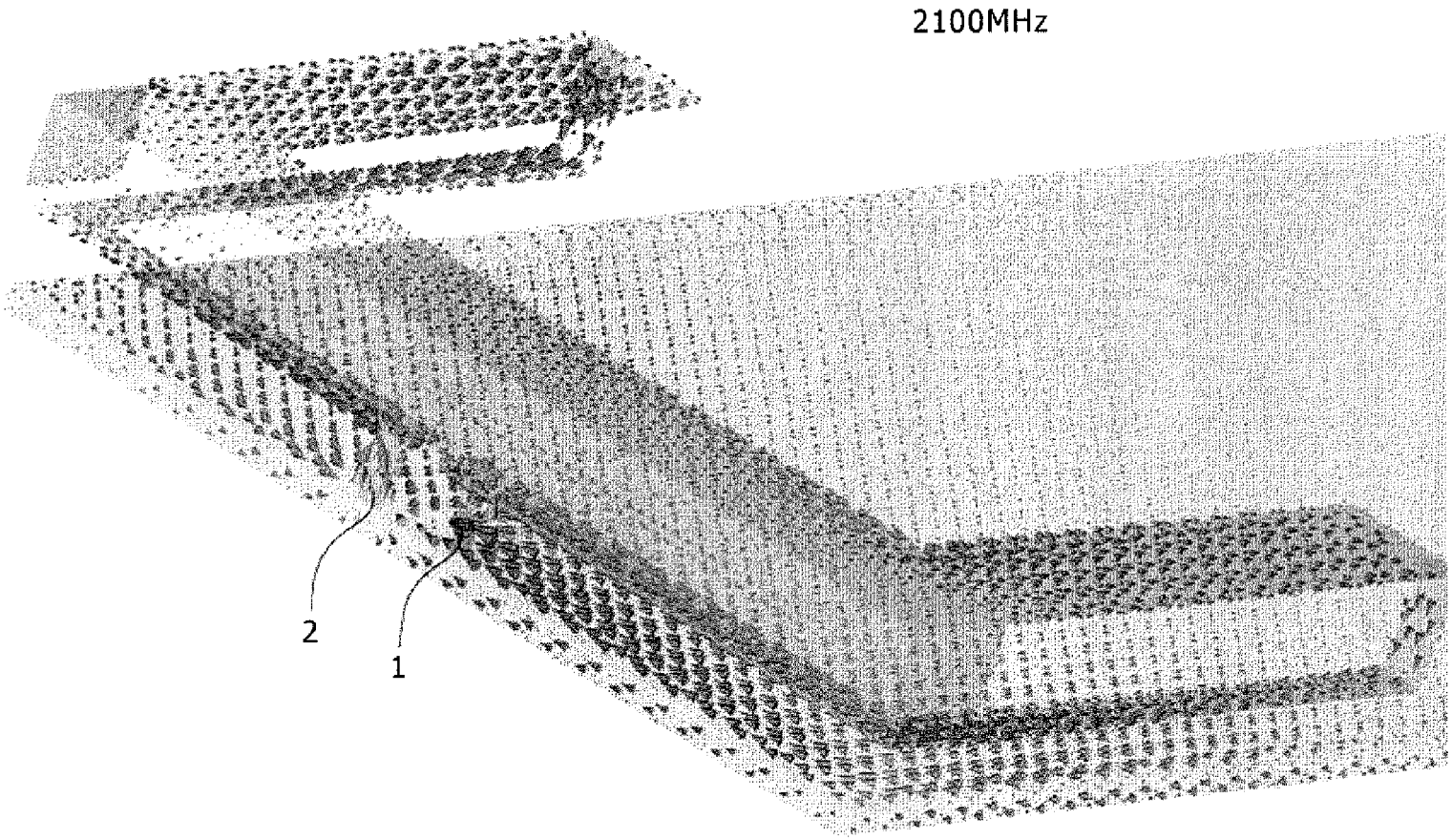
FIG. 9 is a diagram showing current vectors indicative of the states of electric currents flowing through each part of the antenna device in a 2100 MHz band.
Figure 10A:
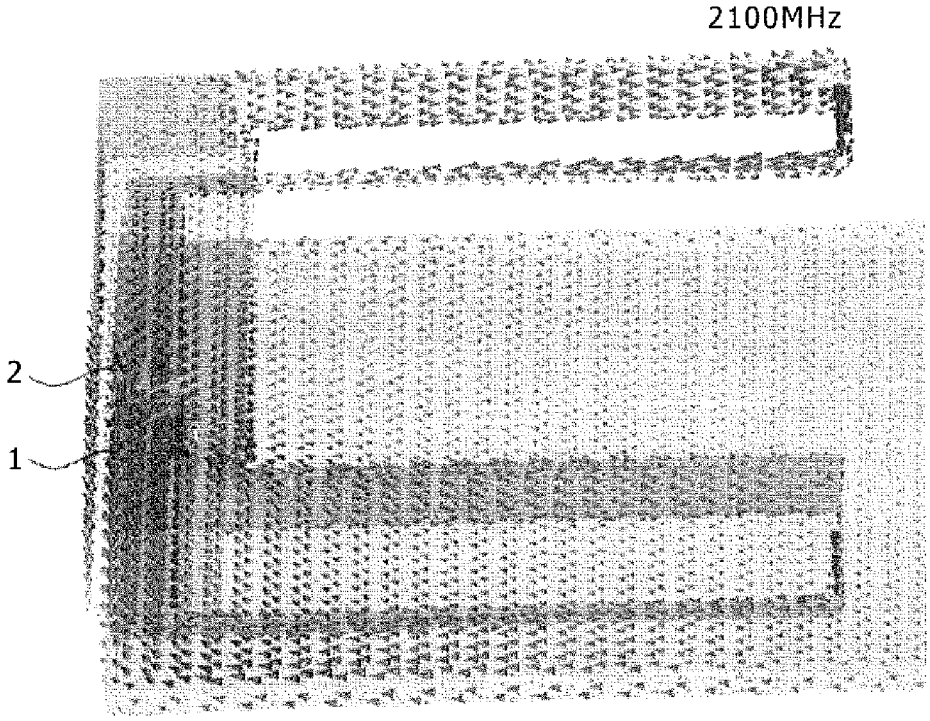
FIGS. 10A and 10B are diagrams showing current vectors indicative of the states of electric currents flowing through each part of the antenna device in the 2100 MHz band, taken from two viewpoints different from FIG. 9.
Figure 10B:
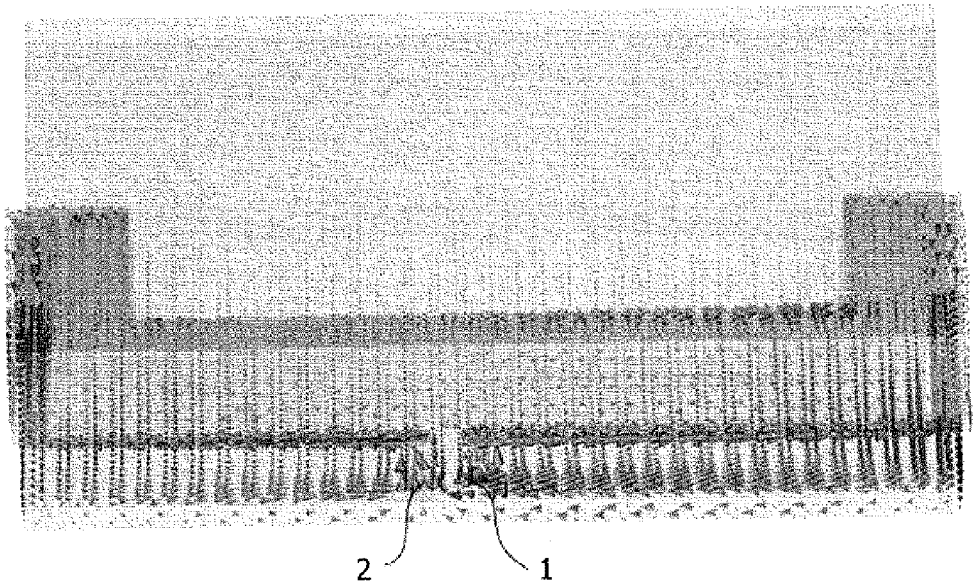

FIGS. 9, 10A, and 10B show current vectors indicative of the states of electric currents flowing through each part of the antenna device in the 2100 MHz band, viewed from three viewpoints. In this case, the flows of currents are in opposite phase. The element length of the antenna device corresponds to λ relative to this frequency band.

Figure 11:
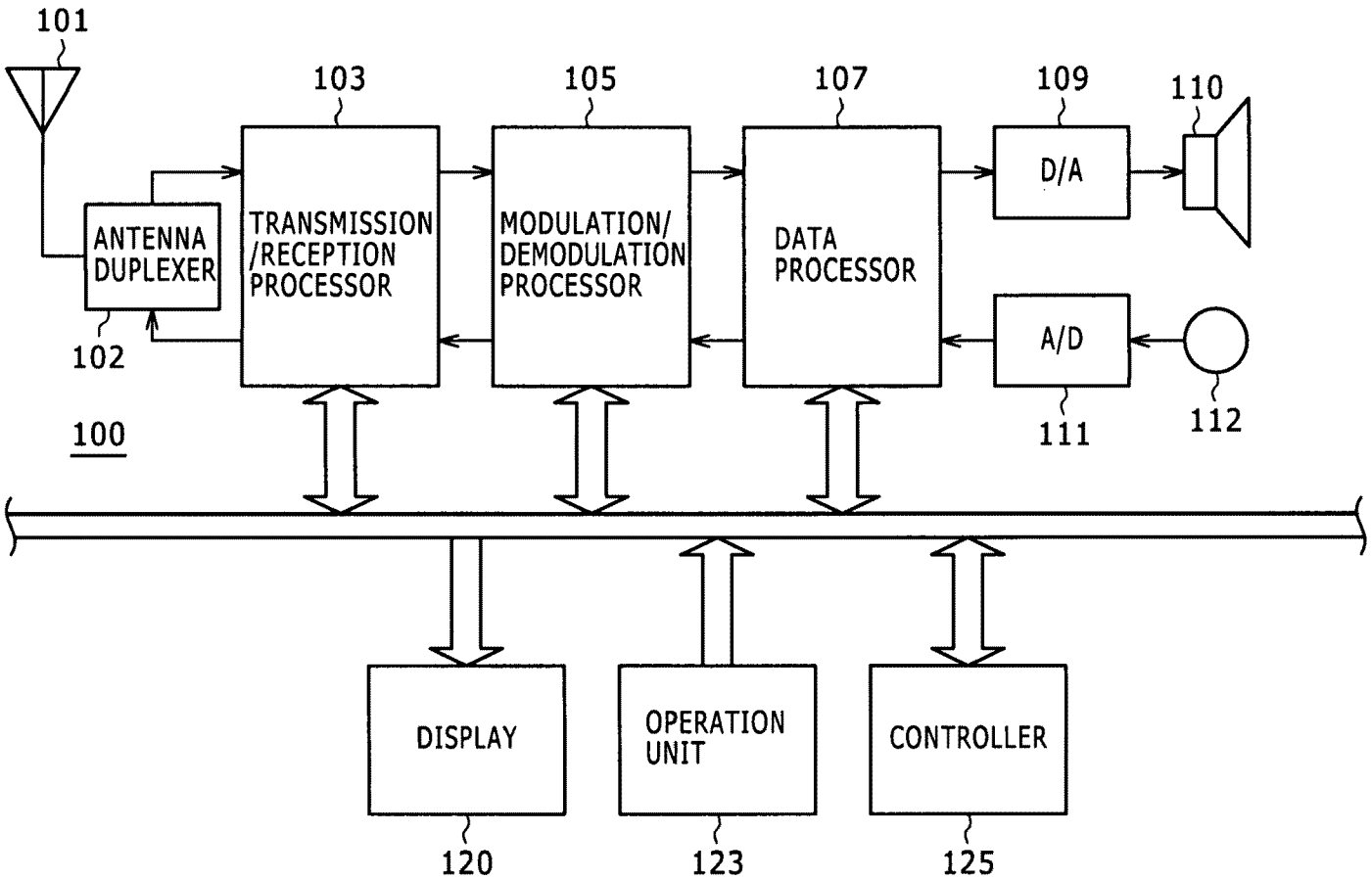
FIG. 11 is a schematic block diagram of a communication terminal apparatus using the antenna device according to the embodiment.

FIG. 11 is a schematic block diagram of a communication terminal apparatus 100 using the antenna device according to this embodiment. The apparatus is a cellular phone as an example, it is but not limited thereto. The communication terminal apparatus 100 has an antenna device 101 having any of the above-described structures, an antenna duplexer 102, a transmission/reception processor 103, a modulation/demodulation processor 105, a data processor 107, a D/A converter 109, a speaker 110, an A/D converter 111, and a microphone 112. The communication terminal apparatus 100 further has a controller 125 which includes a CPU for controlling each unit, ROM and the like, a memory 127 which the controller 125 uses as a storage area for temporarily storing data and a work area, a display 120, and an operation unit 123. The ROM of the controller 125 includes read-only memory and electrically erasable programmable, read-only memory (EEPROM), and stores control programs for various operations, such as operation input acceptance, communication, e-mail processing, web processing, display, audio input/output, telephone directory management, schedule management, etc., and fixed data for use in an ordinary communication terminal apparatus.

As described above, according to this embodiment, there is provided a wide-band antenna device, which can support five radio frequency bands. Further, the structure of this embodiment can relatively reduce the amount of current flowing through the base plate and thereby exert less influence on human bodies. Furthermore, the design of the antenna radiation plate enables impedance matching, thereby negating the need for a matching circuit. Since the antenna element can be so formed as to have empty space inwardly on the base, it is also possible to utilize the space to mount devices such as a camera, a speaker, etc.

While a preferred embodiment of the invention has been described, it should be understood by those skilled in the art that various modifications, combinations, sub-combinations and alterations may occur depending on design requirements and other factors insofar as they are within the scope of the appended claims or the equivalents thereof.

What is claimed is:

1. A loop-structured antenna device comprising:

a pair of first element sections that extend approximately parallel to a base plate, a first end portion of one first element section being connected to a feed point, and a first end portion of another first element section being connected to a ground;

a second element section including a folded-back section connecting a pair of turned-up sections, one turned-up section connecting a first end portion of the folded-back section to a second end portion of the one first element section, and another turned-up section connecting a second end portion of the folded-back section to a second end of the another first element section, the folded-back section being approximately parallel to the first element sections; and a third element section that extends from an edge portion of the folded-back section folded toward the first element sections.

2. The loop-structured antenna device according to claim 1, further comprising a pair of fourth element sections including one fourth element extending from a first end portion of the third element section toward the one turned-up section, and another fourth element extending from a second end portion of the third element section toward the another turned-up section.

3. The loop-structured antenna device according to claim 1, wherein the third element section is connected only to the folded-back section.

4. The loop-structured antenna device according to claim 3, wherein a distal edge of the third element section is closer to the pair of first element sections than to the second element section.

5. The loop-structured antenna device according to claim 1, wherein the length of the third element section and the lengths of the fourth element sections are tuned to allow the antenna device correspond to a 1800 MHz frequency band and a 1900 MHz frequency band.

6. The loop-structured antenna device according to claim 1, wherein the width of the folded-back section corresponding to the first element sections is larger than the width of the first element sections.

7. A mobile radio terminal including the loop-structured antenna device according to claim 1.

8. The dipole antenna device according to claim 1, wherein the dipole antenna device is of an unbalanced feed type.

9. The dipole antenna device according to claim 1, wherein the antenna device is formed from a one-piece metal plate.

* * * * *